US005458376A

United States Patent [19]

Biewald

[11] Patent Number: 5,458,376

[45] Date of Patent: Oct. 17, 1995

[54] STOCK TABLE VISUAL AND INFORMATIONAL AID

[76] Inventor: Harold Biewald, 406-111 Echo Drive, Ottawa, Ontario, Canada, K1S 5K8

[21] Appl. No.: 246,501

[22] Filed: May 20, 1994

[51] Int. Cl.[6] ..... B42D 15/00

[52] U.S. Cl. ..... 283/65; 283/115

[58] Field of Search ..... 283/65, 115, 117, 283/109, 110, 66.1, 901; 281/2, 51

[56] References Cited

U.S. PATENT DOCUMENTS

| | | | |
|---|---|---|---|
| 1,353,279 | 9/1920 | Schulthess . | |
| 2,585,421 | 2/1952 | Armand nee Dumais . | |
| 2,871,816 | 2/1959 | McConnell . | |
| 3,065,668 | 11/1962 | Leybourn et al. . | |
| 3,269,752 | 8/1966 | Lindaman . | |
| 3,739,739 | 6/1973 | Brase . | |
| 4,186,683 | 2/1980 | LeRoy . | |
| 4,580,814 | 4/1986 | Berler | 283/65 X |
| 5,137,302 | 8/1992 | Angel | 283/65 |
| 5,141,253 | 8/1992 | Rice | 283/65 |

*Primary Examiner*—Willmon Fridie

[57] ABSTRACT

A card for use as a visual and informational aid for reading and comprehending horizontally disposed information relating to a stock in a selected financial table in a selected publication, published financial tables include a top line of headings disposed horizontally relative to one another, below the upper horizontal line of headings are horizontal lines containing identifying and financial information relating to a particular stock, the invention comprising a partially transparent generally planar card having at least one horizontal viewing area, horizontally arranged line headings above the viewing area correspond in information and spacing to the information and spacing in the line headings of the specified financial table in the specified publication which is to be read and comprehended, information appearing on said card relative to each viewing area identifying a selected publication and a selected financial table or tables in association with which the viewing area is intended to be used, the viewing area being at least the width and length of each horizontal line of information in the selected financial table.

7 Claims, 3 Drawing Sheets

The Globe and Mail, Saturday, September 10, 1994

NEW YORK

| 1 week Close | Chg | Vol(h) | Yield | Share profit | P/E ratio | 52-week high | low | Stock | Symbol | Div | Friday Hi/bid | Lo/ask | Chg | Vol(h) | This week High | Low | Close | Chg | Vol(h) | Yield | Share profit | P/E ratio | 52-w high |
|---|---|---|---|---|---|---|---|---|---|---|---|---|---|---|---|---|---|---|---|---|---|---|---|
| 12 | +⅝ | 18099 | 0.90 | -0.40 | | 23½ | 15 | Paine Webbr | PWJ | 0.48 | 15⅞ | 15½ | -⅛ | 11050 | 16⅛ | 15½ | 15⅞ | -⅛ | 16486 | 3.07 | 1.90 | 8.2 | 48½ |
| 21⅛ | +1⅛ | 5336 | 1.39 | 0.80 | 36.0 | 15⅞ | 11⅛ | Paine Webber | PIF | 0.80 | 11½ | 11⅛ | | 335 | 11⅞ | 11½ | 11½ | +¼ | 1083 | 6.81 | | | 23½ |
| 7⅞ | | 169 | 1.48 | c-0.87 | | 16⅞ | 10⅞ | Pakistan | PKF | | 11⅛ | 11⅛ | | 528 | 11⅛ | 11⅛ | 11⅛ | | 1492 | | | | 50½ |
| 8 | | 3629 | 1.48 | -0.87 | | 21⅛ | 13⅞ | Pall | PLL | 0.37 | 17⅞ | 17⅞ | -¼ | 2175 | 18 | 17⅞ | 17½ | -⅝ | 7172 | 2.14 | 0.86 | 20.1 | 33½ |
| 31⅛ | -⅜ | 731 | 0.10 | 2.67 | 11.8 | 45⅞ | 23⅞ | Panamerican | PB | | 34⅞ | 33⅞ | +⅞ | 993 | 34⅞ | 32½ | 31⅞ | +2 | 2033 | | 1.43 | 24.0 | 3½ |
| 7 | -½ | 360 | | -0.87 | | 28 | 18⅞ | Panhandle | PEL | 0.80 | 22¼ | 21⅞ | -⅛ | 1154 | 27⅞ | 21½ | 22⅞ | +1½ | 5077 | 3.62 | 1.25 | 17.7 | 51½ |
| 20¼ | +½ | 1837 | 0.49 | 1.20 | 16.9 | 21⅛ | 20½ | Paragon Grp | PAO | | 21 | 20½ | -½ | 327 | 21½ | 20½ | 20½ | -½ | 1395 | | | | 49½ |
| 25⅛ | +½ | 1011 | | | | 36½ | 21⅞ | Paragon Trad | PTB | | 25⅛ | 24½ | +⅛ | 1528 | 25⅞ | 24⅞ | 25⅛ | -⅛ | 2004 | | 2.74 | 9.2 | 40½ |
| 28⅛ | -½ | 1429 | 0.86 | | | 35⅞ | 19⅞ | Parker & Par | PDP | | 27 | 26½ | -⅛ | 1179 | 27¼ | 25⅞ | 26⅞ | +¼ | 6316 | | 0.44 | 60.8 | 23½ |
| 29 | +⅜ | 1214 | 0.24 | | | 49⅞ | 32⅞ | Parker Hannfin | PH | 1.00 | 41½ | 40½ | -1½ | 338 | 42 | 40½ | 40½ | -1 | 1829 | 2.46 | 1.07 | 38.0 | 13⅞ |
| 12⅞ | +½ | 2263 | 3.17 | -0.01 | | 13⅞ | 9⅛ | Patriot Prem | PDT | 0.90 | 9⅞ | 9½ | -⅛ | 388 | 9⅞ | 9½ | 9½ | -⅜ | 938 | 9.58 | | | 24 |
| 17⅛ | -½ | 312 | | 0.63 | 21.2 | 33½ | 23 | Peco Energy | PE | 1.52 | 25⅞ | 25½ | | 3575 | 26⅞ | 25⅞ | 25⅞ | -⅞ | 10150 | 5.90 | 2.49 | 10.3 | 31½ |
| 36⅛ | -1½ | 4077 | 1.77 | 2.41 | 15.0 | 31 | 19½ | Penn Power | PPL | 1.87 | 20⅞ | 19½ | -½ | 4723 | 20⅞ | 19¼ | 19½ | -½ | 24815 | 9.46 | 1.98 | 10.0 | 31⅞ |
| 15⅛ | -½ | 31984 | 1.28 | | | 22⅞ | 14½ | Penncorp Fin | PFG | | 15½ | 15⅛ | +⅛ | 462 | 15½ | 15 | 15½ | | 1153 | | 1.81 | 8.6 | 11½ |
| 19⅛ | -1½ | 1362 | 0.52 | 1.83 | 10.6 | 59 | 40½ | Penney | JCP | 1.00 | 53⅞ | 52½ | -1½ | 5482 | 54⅞ | 51⅞ | 52⅞ | +⅞ | 21389 | 3.18 | 4.06 | 13.0 | 19⅞ |
| 26½ | -⅛ | 2735 | 9.06 | 2.30 | 11.5 | 66⅞ | 45⅛ | Pennzoil | PZL | 2.00 | 51⅛ | 50½ | -½ | 751 | 51⅞ | 50⅛ | 50⅞ | -⅞ | 2231 | 5.93 | 3.51 | 14.4 | 24 |
| 8½ | | 3358 | | 0.79 | 11.2 | 34 | 22⅞ | Peoples Ener | PGL | 1.80 | 27 | 26½ | -½ | 282 | 27⅞ | 26⅞ | 26⅞ | +½ | 1288 | 6.70 | 2.20 | 12.2 | 31 |
| 7⅞ | -⅜ | 3009 | | -0.13 | | 39½ | 22⅞ | Pep Boys | PBY | 0.17 | 35½ | 34⅛ | +⅛ | 1901 | 35⅛ | 34⅛ | 34½ | +½ | 7626 | 0.49 | 1.21 | 28.7 | 7½ |
| 9⅞ | -⅛ | 4907 | 10.26 | | | 42½ | 28⅞ | Pepsico | PEP | 0.72 | 33½ | 32⅞ | | 10514 | 33⅞ | 32⅞ | 33½ | -½ | 42856 | 2.15 | 2.01 | 16.7 | 43½ |
| 20 | | 3247 | | 1.04 | 19.2 | 39½ | 26½ | Perkin Elmer | PKN | 0.68 | 31½ | 31 | -½ | 1757 | 31⅞ | 29⅞ | 31½ | +1½ | 4315 | 2.18 | 1.14 | 27.3 | 10½ |
| 18 | -⅜ | 2100 | 0.42 | 2.21 | 8.6 | 7⅛ | 6½ | Perry Drug | PDS | | 6⅞ | 6 | +⅛ | 97 | 6½ | 5⅞ | 6⅛ | +½ | 792 | | -0.96 | | 10½ |
| 96½ | -½ | 21878 | 4.44 | 1.56 | 36.1 | 20⅞ | 15⅞ | Pet | PT | 0.32 | 19½ | 19½ | -½ | 2943 | 19½ | 18½ | 19 | -⅛ | 9467 | 1.68 | 0.85 | 29.2 | 10 |
| 21½ | -½ | 47872 | 1.70 | 1.65 | 20.1 | 30½ | 23½ | Petrie Stores | PST | 0.20 | 26¼ | 25½ | -½ | 380 | 26½ | 25⅞ | 25⅞ | -⅛ | 1530 | 0.77 | -0.51 | | 42½ |
| 37½ | -1½ | 9584 | 4.36 | 4.03 | 9.3 | 30⅞ | 27⅞ | Petrol & Res | PEO | 0.63 | 29 | 28⅞ | | 85 | 29⅞ | 28⅞ | 28⅞ | +½ | 572 | 2.07 | 1.28 | 22.8 | 34½ |
| 16½ | -½ | 182 | 5.09 | | | 79½ | 53½ | Pfizer | PFE | 1.00 | 67⅛ | 66½ | -½ | 3518 | 67⅞ | 66½ | 67½ | +½ | 19848 | 2.00 | 2.27 | 29.6 | 77½ |
| 36 | -½ | 2536 | | -2.09 | | 19¼ | 8⅛ | Pharma Res | PRX | | 9⅛ | 8½ | -½ | 686 | 9½ | 8½ | 9½ | -½ | 1073 | | -0.12 | | 8½ |
| 1⅛ | -½ | 348 | | -4.83 | | 64 | 38⅛ | Phelps Dodge | PD | 1.85 | 63 | 61½ | -½ | 3058 | 62½ | 61⅛ | 61⅞ | -1½ | 14000 | 2.98 | 2.74 | 22.5 | 39½ |
| 30½ | -½ | 1395 | | 1.71 | 17.8 | nd 62⅛ | 45⅛ | Philip Morris | MO | 3.30 | 60½ | 59½ | -½ | 24959 | 61½ | 59½ | 59½ | -½ | 106034 | 5.51 | 4.24 | 14.1 | 39½ |
| 21½ | -½ | 8458 | 2.13 | 1.21 | 17.5 | 33⅞ | 19 | Philips Nv | PHG | | 33⅛ | 33⅛ | -½ | 775 | 33⅞ | 33⅛ | 33⅛ | -½ | 4268 | | 3.17 | 10.4 | 38½ |
| 73½ | -2¼ | 11478 | 3.02 | 7.02 | 10.7 | 37⅞ | 25½ | Phillips Pet | P | 1.12 | 35 | 34½ | -½ | 7845 | 35½ | 33 | 34½ | +1½ | 29831 | 3.22 | 1.01 | 34.4 | 49½ |
| 45½ | | 421 | 1.96 | 1.97 | 23.0 | 38 | 17½ | Phillips Ventle | PVH | 0.15 | 23½ | 22½ | -½ | 536 | 23½ | 22½ | 22½ | -⅛ | 2104 | 0.68 | 1.47 | 15.6 | 16½ |
| 81½ | -1⅛ | 2262 | 1.09 | 1.74 | 52.7 | 11¼ | 7⅛ | Pier One Impo | PIR | 0.10 | 8½ | 8½ | -⅛ | 1235 | 8½ | 8½ | 8½ | | 3343 | 1.21 | 0.19 | 43.4 | 50¼ |
| 16½ | +½ | 115147 | 10.63 | 2.17 | 7.7 | 10 | 8 | Pilgrim Prime | PPR | 0.74 | 9⅞ | 9½ | | 1577 | 9⅞ | 9½ | 9½ | +½ | 7759 | 7.49 | | | 10½ |
| 34 | -½ | 1640 | 3.29 | 2.46 | 13.8 | 24⅞ | 16 | Pinnacle Wst | PNW | 0.80 | 17¼ | 17½ | -½ | 1378 | 18 | 17½ | 17½ | -½ | 6571 | 4.64 | 1.99 | 8.7 | 25½ |
| 10⅛ | -½ | 4067 | 2.07 | 0.38 | 30.7 | 30½ | 20½ | Pioneer Elec | PIO | 0.20 | 27 | 26½ | -½ | 14 | 26½ | 26½ | 26½ | -1½ | 95 | 0.75 | 0.09 | 297.2 | 34½ |
| 39½ | -½ | 10838 | 1.52 | 2.86 | 13.6 | 18½ | 9½ | Piper Jaffray | PJC | 0.70 | 10⅞ | 10½ | +½ | 401 | 11½ | 10¼ | 10⅞ | -½ | 2903 | 6.59 | 1.84 | 5.8 | 28½ |
| 14⅛ | +½ | 1213 | | 0.08 | 176.1 | 46½ | 34½ | Pitney Bowes | PBI | 1.04 | 37½ | 36½ | -½ | 2263 | 37½ | 36½ | 36½ | -½ | 6178 | 2.82 | 2.28 | 16.2 | 56½ |
| 44½ | +2½ | 9814 | 2.23 | 0.34 | 132.0 | 31½ | 19½ | Pittston Servi | PZS | 0.65 | 28½ | 28 | +½ | 673 | 28½ | 27½ | 28½ | +1½ | 3986 | 0.17 | 1.67 | 17.2 | 27½ |
| 34½ | -½ | 10296 | 1.44 | 2.25 | 15.1 | 28½ | 18½ | Placer Dom | PDG | 0.28 | 23½ | 23⅛ | +½ | 9694 | 24½ | 23 | 23½ | -½ | 47031 | 1.11 | 0.56 | 41.7 | 39½ |
| 35½ | -½ | 15801 | 0.51 | 1.20 | 29.4 | 38½ | 19½ | Plains Pete | PLP | 0.24 | 22½ | 22 | -½ | 189 | 22½ | 21½ | 22½ | +½ | 878 | 1.08 | 0.18 | 123.6 | 62½ |
| 19⅛ | +½ | 12216 | | 3.77 | 5.1 | 25½ | 14½ | Plantronics | PLT | | 25½ | 22½ | +2 | 880 | 25½ | 22 | 25 | +2½ | 1005 | | 0.77 | 32.5 | 46½ |
| 32 | +½ | 9990 | 2.75 | 1.67 | 19.2 | 13½ | 7½ | Playtex Prod | PYX | | 9½ | 9½ | -½ | 1552 | 9½ | 8½ | 9½ | +½ | 9257 | | -11.05 | | 133½ |
| 22⅞ | +½ | 1104 | 2.00 | 1.36 | 16.8 | 32½ | 19½ | Plum Creek | PCL | 1.00 | 25 | 24½ | -½ | 345 | 25 | 24½ | 24½ | -½ | 1272 | 7.31 | 2.06 | 12.0 | 78½ |
| 35½ | -½ | 734 | 2.62 | 0.16 | 221.9 | 34¼ | 14½ | Pogo Prod | PPP | 0.12 | 22¼ | 21½ | -½ | 2231 | 22½ | 20½ | 21½ | +1½ | 12517 | 0.55 | 0.89 | 24.8 | 56½ |
| 32½ | +1½ | 18523 | 2.78 | 0.97 | 33.4 | 37½ | 28½ | Polaroid | PRD | 0.80 | 35 | 34½ | -½ | 678 | 35½ | 34 | 34½ | +½ | 2506 | 1.73 | 2.01 | 17.3 | 20½ |
| 7½ | -½ | 1265 | | -1.01 | | 39½ | 22½ | Policy Mgmt | PMS | | 38½ | 37½ | -½ | 3510 | 39½ | 37 | 38½ | +1½ | 5826 | | 0.80 | 47.8 | 20½ |
| 99⅛ | -⅞ | 6139 | 2.08 | 5.99 | 10.0 | 46½ | 33½ | Polygram | PLG | | 43½ | 43 | -½ | 226 | 44½ | 43 | 43½ | -1½ | 950 | | 1.93 | 22.3 | 30½ |
| 24 | -1½ | 11294 | 3.00 | 1.53 | 15.7 | 32½ | 17½ | Pope & Talbot | POP | 0.78 | 21½ | 20½ | +½ | 367 | 21½ | 20½ | 21½ | -½ | 1805 | 3.53 | 1.39 | 15.5 | 15½ |
| 37½ | -1½ | 7352 | 4.83 | 3.03 | 12.3 | 23 | 16½ | Portland Gen | PGN | 1.20 | 17½ | 17½ | -⅛ | 732 | 17½ | 17½ | 17¼ | -½ | 2064 | 6.96 | 2.11 | 8.2 | 8½ |
| 25½ | | 832 | 8.00 | | | 19 | 11½ | Portugal Fd | PGF | 0.01 | 15½ | 14½ | | 159 | 15½ | 14½ | 15 | +½ | 825 | 0.07 | | | 9½ |
| 8½ | -½ | 9732 | 8.48 | | | 36⅛ | 18¼ | Potash Sask | POT | 1.44 | 36½ | 35½ | +½ | 1945 | 36⅛ | 33½ | 36½ | +2½ | 10618 | 3.97 | 2.31 | 15.7 | 59½ |
| 6½ | -⅛ | 3670 | 0.00 | | | 49½ | 36 | Potlatch | PCH | 1.56 | 43½ | 43½ | -½ | 410 | 44 | 42½ | 43½ | +½ | 1601 | 3.59 | 0.73 | 59.6 | 51½ |
| 6½ | | 19785 | 0.46 | | | 28½ | 18½ | Potomac El | POM | 1.00 | 19½ | 19½ | -½ | 1657 | 19½ | 19½ | 19½ | -½ | 7378 | 5.57 | 1.02 | 10.8 | 11½ |
| 8½ | | 8650 | 0.78 | | | 22½ | 14½ | Praxair | PX | 0.28 | 21½ | 21½ | -½ | 1398 | 22½ | 21½ | 21½ | -½ | 14178 | 1.29 | 1.23 | 17.6 | 12½ |
| 30⅞ | -⅜ | 5161 | 0.53 | 2.40 | 12.6 | 26½ | 15½ | Precision Cast | PCP | 0.24 | 26½ | 26½ | -½ | 410 | 26½ | 26½ | 26½ | +½ | 1312 | 0.91 | 1.31 | 20.2 | 69½ |
| 28½ | | 3009 | | -1.88 | | 46½ | 30½ | Premark Intl | PMI | 0.80 | 46½ | 45½ | -½ | 3370 | 46½ | 45½ | 45½ | +½ | 7966 | 1.75 | 3.02 | 15.1 | 69½ |
| 19½ | +½ | 2605 | | 1.09 | 17.8 | 14½ | 8 | Premdor | PI | | 8½ | 8½ | -½ | 5 | 8½ | 8½ | 8½ | -½ | 33 | | 0.66 | 12.9 | 48½ |
| 33 | +2½ | 2594 | 1.52 | 1.00 | 33.0 | 29½ | 17½ | Premier Ind | PRE | 0.40 | 22 | 21½ | | 502 | 22½ | 21½ | 21½ | -½ | 1213 | 1.84 | 1.10 | 19.8 | 60½ |
| 26½ | +½ | 3369 | 1.44 | 0.94 | 28.1 | 9½ | 5½ | Pride Cos | PRF | | 6 | 5½ | -½ | 46 | 6 | 5½ | 5½ | -½ | 163 | | | | 24½ |
| 18½ | +½ | 14343 | | 0.78 | 23.7 | 8½ | 3½ | Prime Hosp't | PDQ | | 8½ | 8⅛ | -½ | 1570 | 8⅞ | 8⅛ | 8⅛ | +½ | 4995 | | 0.44 | 19.0 | 37½ |
| 72½ | +½ | 1078 | | | | 60½ | 45½ | Procter Gamble | PG | 1.40 | 58 | 58 | -½ | 6565 | 60½ | 58 | 58½ | -1½ | 23538 | 2.39 | 3.09 | 18.9 | 26½ |
| 36½ | -½ | 11128 | 2.72 | c3.96 | 13.6 | 40½ | 27½ | Progressive - | PGR | 0.22 | 36½ | 36½ | | 190 | 37 | 36½ | 36½ | -½ | 1560 | 0.61 | 3.17 | 11.4 | 45 |
| 13½ | -½ | 1098 | | -1.84 | | 55½ | 27½ | Promus Cos | PRI | | 37½ | 35½ | -½ | 7515 | 38 | 35½ | 36 | -½ | 25750 | | 1.22 | 29.5 | 29 |
| 24½ | -½ | 1845 | 0.08 | | | 34 | 26½ | Provident Cp | PVN | | 33½ | 33 | -½ | 1718 | 33½ | 32 | 33 | +½ | 3960 | | 3.03 | 10.9 | 26½ |
| 22½ | | 10938 | | 1.33 | 24.2 | 27 | 19½ | Pst Res | PIN | 1.24 | 21½ | 21½ | -½ | 2575 | 22 | 21½ | 21½ | -½ | 5703 | 5.84 | 1.74 | 12.2 | 30½ |

FIG.2

STOCK TABLE VISUAL AND INFORMATIONAL AID

This invention relates to a visual and informational aid for use in reading and comprehending stock tables reported generally in daily newspapers, weekend newspapers, weekly financial newspapers and in other publications which include stock tables. The word stock as used herein includes bonds, mutual funds, and other financial instruments reported in financial tables.

There are a number of problems associated with reading information relating to an individual stock in a financial table. Some publications provide five elements of information per horizontal line relating to a particular stock while other publications may provide up to ten elements of information per line relating to a particular stock. In fact, many of the same newspapers provide wider columns with more elements of information on Saturday or Sunday compared with the elements of information provided in the financial tables of the same publication during the week. Each element of information has a heading at the top of the table such as "Stock", "Abbreviation", "52 wk. high", 52 wk. low etc. It is difficult to relate information relating to a particular stock listed on the lower three quarters of the page with one of numerous column headings located only at the top of the page.

Another problem in reading financial tables lies in locating the stock of interest and reading the financial information relating to that particular stock which extends horizontally across the page from the name or abbreviation of the stock.

The visual and informational aid which is the subject of this invention facilitates the location of a particular stock through the use of a transparent card including at least one horizontally disposed viewing area. While reference has been made to a transparent card it will be appreciated that transparency is most important on the left hand side of the card so that the stock of interest may be located. The center and right hand side of the card may contain logos, information and the like on the surface of the card. The width and length of each horizontally disposed viewing area is greater than the width and length of the particular horizontal line of information relating to the particular stock of interest. The visual and informational aid assists in lining up the information relevant to each particular stock listed. The viewing area will always be open or transparent.

The information and spacing of information of the column headings found at the top of the page is repeated on the face of the card immediately above the horizontally disposed viewing area. Once the name or abbreviation of the stock of interest has been located in the horizontal viewing area, the card may be moved untfi the name or abbreviation of the stock appears in the left hand side of the horizontal viewing area and the remainder of the horizontal line containing stock information appears in the horizontally disposed viewing area. The column headings located on the card immediately above the horizontal viewing area correspond to the column headings at the top of the page and identify the information in the horizontal viewing area immediately below the informational heading on the card. The person using the card can read the financial information even if the page is folded in half as reference to the column headings at the top of the page is not necessary when the corresponding column headings appear on the card immediately above the viewing area. Use of the card results in immediate association of column headings with the financial information relating to the stock of interest appearing in the horizontal viewing area immediately below the column heading on the card.

One embodiment of the invention relates to a card for use as a visual and informational aid for reading and comprehending horizontally disposed information relating to a stock in a selected financial table in a selected publication, published financial tables including a top line of headings disposed horizontally relative to one another, below the upper horizontal line of line headings are horizontal lines containing identifying and financial information relating to a particular stock, the invention comprising a partially transparent generally planar card having at least one horizontal viewing area, horizontally arranged line headings above the viewing area corresponding in information and spacing to the information and spacing in the line headings of the specified financial table in the specified publication which is to be read and comprehended, information appearing on said card relative to each viewing area identifying a selected publication and a selected financial table or tables in association with which the viewing area is intended to be used, the viewing area being at least the width and length of each horizontal line of information in the selected financial table.

In the drawings:

FIG. 2 is an example of part of a stock table for the New York Stock Exchange appearing in a Saturday edition of a newspaper having 17 entries for each stock listed in the column.

Figure 1:
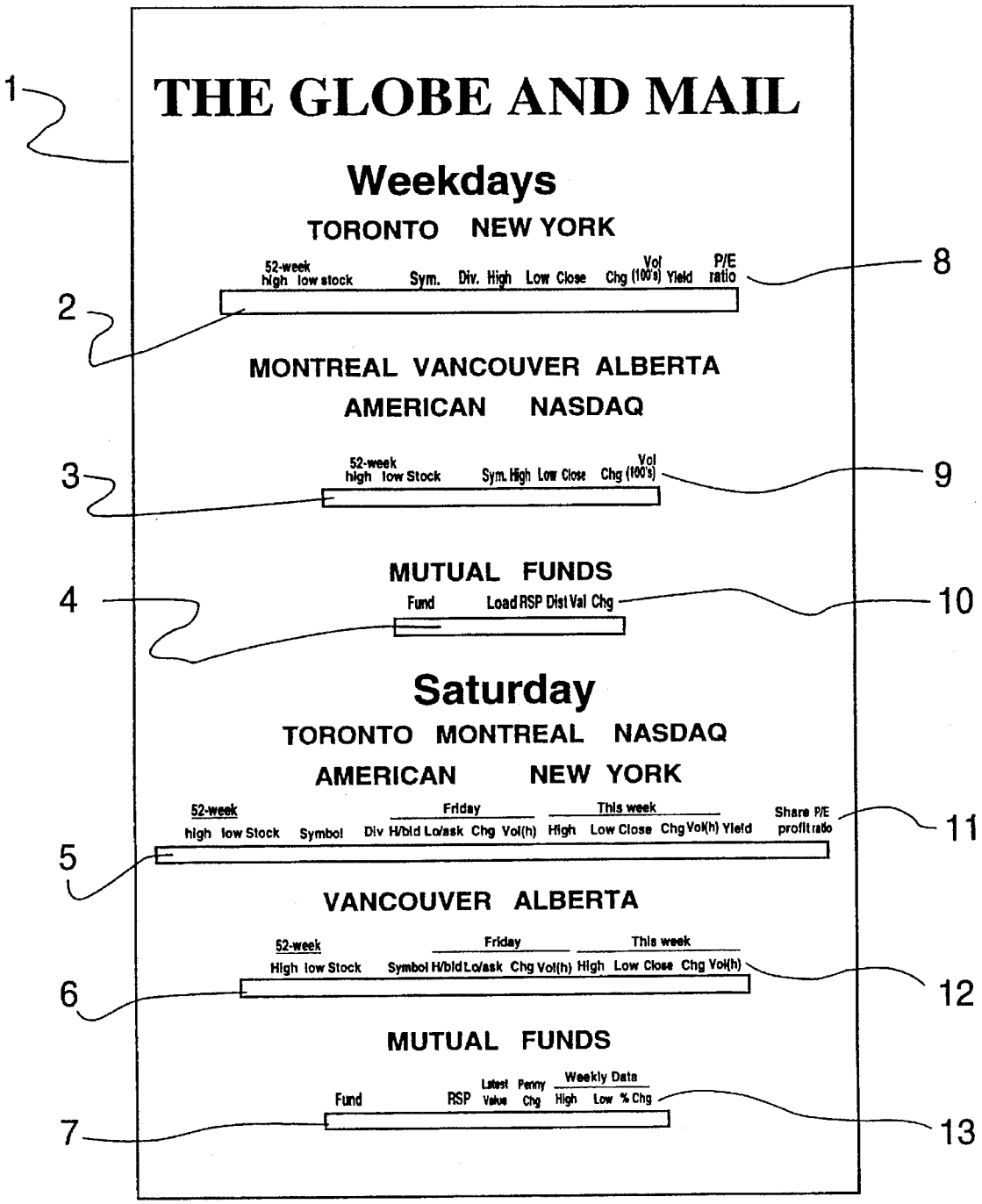
FIG. 1 is a plan view of the informational and visual aid having six horizontal viewing areas.

Referring to FIG. 1, there is shown a transparent card 1 which may be made of transparent plastic material. The card I includes elongated slots 2, 3, 4, 5, 6 and 7. The width of the slots is slightly greater than the height of the print in which the financial information is presented in print in the financial table which is intended to be read with the assistance of one of the slots 2, 3, 4, 5, 6 or 7 of card 1. Immediately above each slot are column headings 8, 9, 10, 11, 12 and 13 which correspond to the column headings found at the top of the financial tables in the publication which is intended to be viewed by the reader.

Referring to FIG. 2, there is shown a part of a financial table listing stocks listed with the New York Stock Exchange showing results relating to weekly trading in each particular stock during the preceding week.

Figure 3:
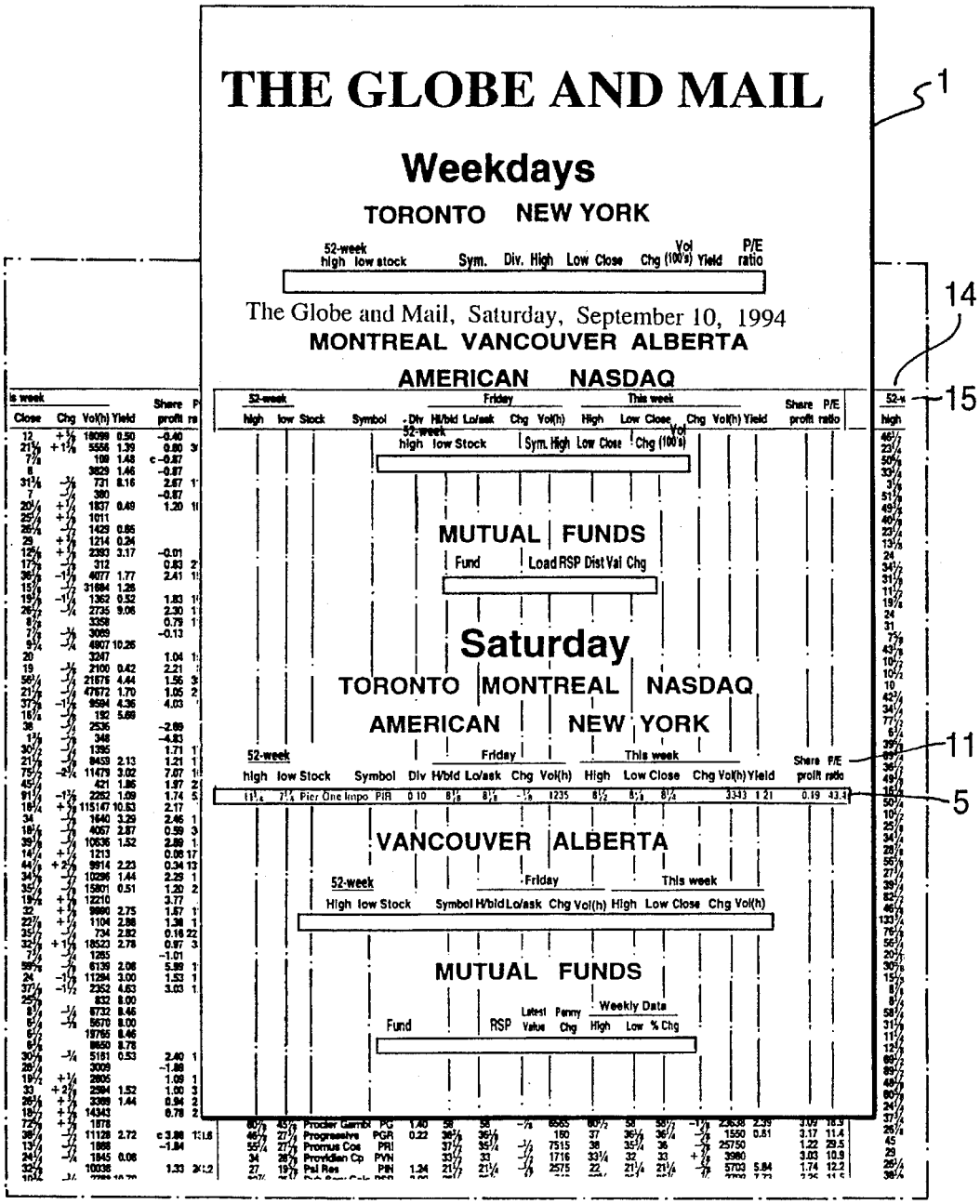
FIG. 3 is a plan view of the informational and visual aid of FIG. 1 mounted over a financial table of the type shown in FIG. 2 so that one financial appears in the slot for the Saturday stock table containing the weekly results of stocks listed on the New York Stock Exchange.

Referring to FIG. 3, there is shown part of a stock table 14 appearing in a Saturday edition of the same newspaper containing a financial table similar to that shown in FIG. 2 containing 17 column headings in respect of each stock reported in the financial table 14. The transparent card 1 of FIG. 1 is shown applied over the financial table 14 so that the slot 5 for Saturday for the New York Stock Exchange is placed about a particular financial in stock table 14 so that the information on that particular stock appears in the slot 5. Immediately above the slot 5 is the column heading 11 corresponding to the column headings 15 at the top of the financial table 14.

The column heading 11 appearing on the card i enables the user of the card 1 to see the stock of interest and the column headings 11 located immediately above the slot 5 adjacent one another. Without card 1 the user would have to place his finger on the column in which the user was interested and look to the top of the page to determine the column heading 15 of the column of particular interest and then return the user's eye to the horizontal line containing the financial information relating to the stock of interest. Depending on the stock the column headings 15 at the top of the financial table 14 may be more than two feet from the financial information relating to the stock of interest. The card 1 serves the purpose of transposing the column headings 15 to a position immediately above the stock of interest.

The width of the columns of financial tables and the numbers of columns in financial tables may differ from publication to publication. The spacing of column headings and number of column headings may also differ from publication to publication.

The cards are prepared with column headings for a particular newspaper or other publication being applied to the card 1 immediately above the slots 2 to 7 during the process of preparation of the card. The card 1 must be custom made as there is considerable variance in the information contained in the column headings 8 to 13, the size of print, and the width of columns in which stocks are reported in various financial publications.

In another embodiment a transfer containing the column headings 8 to 13 may be provided with the card I and the user may transfer column titles to the card immediately above one or more horizontally disposed viewing areas so that the column headings 8 to 13 applied to the card correspond in title and spacing to the column headings 8 to 13 of the publication in which the reader is interested.

While FIGS. 1 and 2 show slots 2 to 7 as the viewing areas it will be appreciated that the viewing area may be created by using a graphic border applied to the surface of the card.

FIGS. 1 and 2 include slots 2 to 7 which are of sufficient length to include all the information found in a horizontal column relating to a particular stock the previous day, week, month or year. The card 1 may be longer and contain additional slots with each slot being the proper length and width and containing column headings corresponding to the column headings found on the financial pages of a newspaper specific or other publications containing specific financial tables available in the community.

I claim:

1. A card for use as a visual and informational aid for reading and comprehending horizontally disposed information relating to a stock in a selected financial table in a selected publication, published financial tables including a top line of headings disposed horizontally relative to one another, below the upper horizontal line of line headings are horizontal lines containing identifying and financial information relating to a particular stock, the invention comprising a partially transparent generally planar card having at least one horizontal viewing area, horizontally arranged line headings above the viewing area corresponding in information and spacing to the information and spacing in the line headings of the specified financial table in the specified publication which is to be read and comprehended, information appearing on said card relative to each viewing area identifying a selected publication and a selected financial table or tables in association with which the viewing area is intended to be used, the viewing area being at least the width and length of each horizontal line of information in the selected financial table.

2. The visual and informational aid for use in reading and comprehending horizontally disposed information relating to an individual financial forming part of a table of stock information of claim 1 in which the card contains at least two horizontal viewing areas.

3. The visual and informational aid for use in reading and comprehending horizontally disposed information relating to an individual stock forming part of a table of financial information of claim 1 in which the horizontal viewing area is an open slot in the card.

4. The visual and informational aid for use in reading and comprehending horizontally disposed information relating to an individual stock forming part of a table of financial information of claim 1 in which the horizontal viewing area is defined by lines applied on the card.

5. The visual and informational aid for use in reading and comprehending horizontally disposed information relating to an individual stock forming part of a table of financial information of claim 1, in which the information headings are applied above the slot from a transfer containing informational headings.

6. The visual and informational aid for use in reading and comprehending horizontally disposed information relating to an individual stock forming part of a table of financial information of claim 3 in which a narrow outline is provided about the horizontally viewing area or areas.

7. The visual and informational aid for use in reading and comprehending horizontally disposed information relating to an individual stock forming part of a table of financial information of claim 1 in which a narrow outline is provided about the horizontally viewing area or areas.

* * * * *